US010390557B2

(12) United States Patent
Börjesson et al.

(10) Patent No.: US 10,390,557 B2
(45) Date of Patent: Aug. 27, 2019

(54) ORAL SMOKELESS TOBACCO COMPOSITION COMPRISING LIBERATED, DELIGNIFIED TOBACCO FIBRES AND A METHOD FOR ITS MANUFACTURE

(71) Applicant: SWEDISH MATCH NORTH EUROPE AB, Stockholm (SE)

(72) Inventors: Bengt Börjesson, Nol (SE); Martin Sjögren, Västra Frölunda (SE)

(73) Assignee: Swedish Match North Europe AB, Stockholm (SE)

( * ) Notice: Subject to any disclaimer, the term of this patent is extended or adjusted under 35 U.S.C. 154(b) by 127 days.

(21) Appl. No.: 14/912,592

(22) PCT Filed: Oct. 9, 2014

(86) PCT No.: PCT/EP2014/071645
§ 371 (c)(1),
(2) Date: Feb. 17, 2016

(87) PCT Pub. No.: WO2015/052282
PCT Pub. Date: Apr. 16, 2015

(65) Prior Publication Data

US 2016/0205993 A1 Jul. 21, 2016

(30) Foreign Application Priority Data

Oct. 9, 2013 (EP) ..... 13187948

(51) Int. Cl.
*A24B 15/30* (2006.01)
*A24B 7/00* (2006.01)
(Continued)

(52) U.S. Cl.
CPC ..... *A24B 15/305* (2013.01); *A24B 7/00* (2013.01); *A24B 13/00* (2013.01); *A24B 15/18* (2013.01);
(Continued)

(58) Field of Classification Search
CPC ..... A24B 15/305; A24B 13/00
(Continued)

(56) References Cited

U.S. PATENT DOCUMENTS 3,067,068 A 12/1962 Finberg
3,516,416 A 6/1970 Briskin et al.
(Continued)

FOREIGN PATENT DOCUMENTS

CN 1382400 12/2002
CN 1820664 8/2006
(Continued)

OTHER PUBLICATIONS

Carvalho, et al., *A comparative study for two automated techniques for measuring fiber length*, Tappi Journal, vol. 80, No. 2, Feb. 1997, pp. 137-142 XP002682636 Atlanta, US ISSN: 0734-1415.
(Continued)

*Primary Examiner* — Eric Yaary
*Assistant Examiner* — Russell E Sparks
(74) *Attorney, Agent, or Firm* — Knobbe Martens Olson & Bear LLP

(57) ABSTRACT

A smokeless tobacco composition for oral use comprising liberated, delignified tobacco fibers, a method for its manufacturing and use, as well as a pouch comprising the composition.

20 Claims, 4 Drawing Sheets

Figure 1:
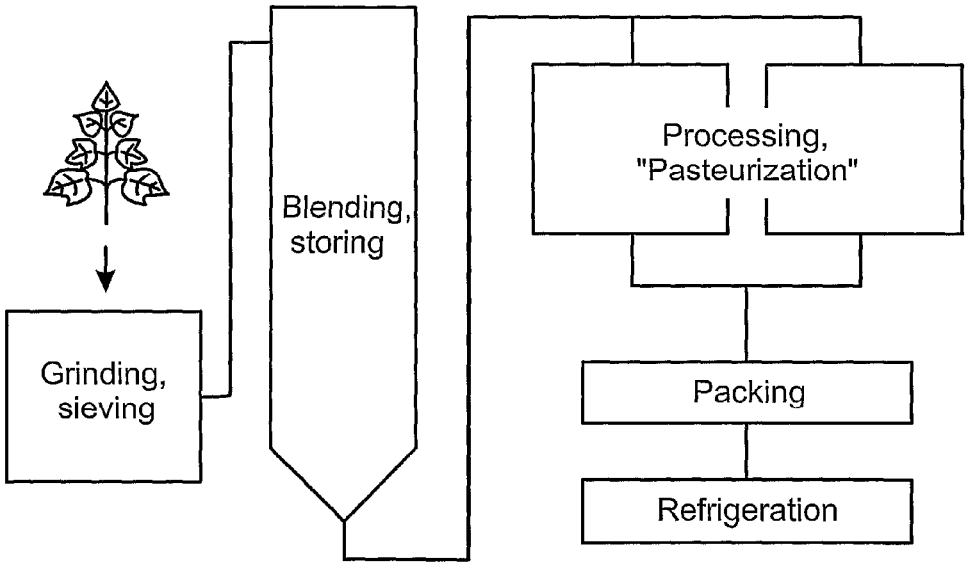

(51) Int. Cl.

| | |
|---|---|
| ***A24B 13/00*** | (2006.01) |
| ***A24B 15/18*** | (2006.01) |
| ***A24B 15/28*** | (2006.01) |
| ***A24F 23/02*** | (2006.01) |

(52) U.S. Cl.
CPC ..... *A24B 15/183* (2013.01); *A24B 15/287* (2013.01); *A24F 23/02* (2013.01)

(58) Field of Classification Search
USPC ..... 131/290
See application file for complete search history.

(56) References Cited

U.S. PATENT DOCUMENTS

| | | | | |
|---|---|---|---|---|
| 4,119,104 | A | 10/1978 | Roth | |
| 4,133,317 | A | 1/1979 | Briskin | |
| 4,306,578 | A | 12/1981 | Schmidt et al. | |
| 4,987,907 | A | 1/1991 | Townend | |
| 5,060,676 | A | 10/1991 | Hearn et al. | |
| 8,387,623 | B2 * | 3/2013 | Atchley | A24B 13/00 131/119 |
| 8,602,068 | B2 * | 12/2013 | Williams | B65B 9/20 141/65 |
| 2005/0244521 | A1 | 11/2005 | Strickland et al. | |
| 2007/0186942 | A1 | 8/2007 | Strickland et al. | |
| 2010/0187143 | A1 | 7/2010 | Essen et al. | |
| 2010/0300464 | A1 | 12/2010 | Gee et al. | |
| 2011/0083688 | A1 | 4/2011 | Mishra et al. | |
| 2011/0247640 | A1 | 10/2011 | Beeson et al. | |
| 2013/0206153 | A1 * | 8/2013 | Beeson | A24B 15/24 131/297 |
| 2013/0276801 | A1 * | 10/2013 | Byrd, Jr. | C08H 8/00 131/297 |
| 2015/0096576 | A1 * | 4/2015 | Gao | A24B 15/16 131/290 |

FOREIGN PATENT DOCUMENTS

| | | |
|---|---|---|
| GB | 2028095 | 3/1980 |
| GB | 2 495 893 | 4/2013 |
| JP | H 03061471 | 3/1991 |
| WO | WO 2004/021809 | 3/2004 |
| WO | WO 2008/153565 | 12/2008 |
| WO | WO 2013/152918 | 10/2013 |
| WO | WO 2013/158957 | 10/2013 |

OTHER PUBLICATIONS

Yang, et al., *Geographic variation and provenance selection for bamboo wood properties in Bambusa chungii*, J of Forestry Res (Harbin), vol. 20, No. 3, Sep. 2009, pp. 261-267, XP002700172, p. 263; table 3.

International Search Report for International Application No. PCT/EP2013/055417 dated Jul. 24, 2013.

Jan. 29, 2015, Int'l Search Report from related PCT App. PCT/EP2014/071645 filed Oct. 9, 2014.

Chunilall et al. A CP/MAS $^{13}$C-NMR study of cellulose fibril aggregation in eucalyptus dissolving pulps during drying and the correlation between aggregate dimensions and chemical reactivity. Holzforschung, vol. 64, pp. 693-698, 2010.

Larsson et al. "A CP/MAS $^{13}$C-NMR investigation of molecular ordering in celluloses." Carbohydrate Research 302 (1997) 19-25.

Rydholm, Sven A. Pulping Processes. Interscience Publishers, 1965.

Wahlberg, and Ringberger. Tobacco: Production, Chemistry and Technology, (eds D.L. Davis & M.T. Nielsen). Chapter 14: Smokeless Tobacco. pp. 452-460. World Agriculture Series, Blackwell Science Ltd. (1999).

Wickholm et al. Assignment of non-crystalline forms in cellulose I by CP/MAS $^{13}$C-NMR spectroscopy. Carbohydrate Research 312 (1998) 123-129.

* cited by examiner

ORAL SMOKELESS TOBACCO COMPOSITION COMPRISING LIBERATED, DELIGNIFIED TOBACCO FIBRES AND A METHOD FOR ITS MANUFACTURE

CROSS REFERENCE TO RELATED APPLICATIONS

This application is a U.S. National Phase Application of PCT International Application No. PCT/EP2014/071645, filed Oct. 9, 2014, designating the Untied States of America and published in the English language, which is an International Application of and claims benefit of priority to European Patent Application No. 13187948.8, filed on Oct. 9, 2013. The disclosures of the above-referenced applications are hereby expressly incorporated by reference in their entireties.

The present invention relates to an oral smokeless tobacco composition comprising liberated, delignified tobacco fibres, a method for its manufacturing and use, as well as a pouch comprising the composition.

BACKGROUND

There are many various forms of oral smokeless tobacco. Such forms include chewing tobacco and snuff. Snuff is available in two forms, as dry snuff for oral or nasal use and moist (or wet) snuff. There are two types of moist snuff, the American and the Scandinavian type. American-type moist snuff is available in a loose form or as pre-packed pouches and is typically used between the lower gum and lip. The use of American-type moist snuff is commonly called dipping. Snus is the Scandinavian-type of moist snuff which is also available in loose form or as pre-packed portions in pouches. Snus is typically used between the upper gum and lip.

Oral smokeless tobacco products are made from tobacco leaves, such as lamina and stem of the leaf. The material from roots and stalks are not utilized for production of oral smokeless tobacco compositions.

There are a number of properties of the oral smokeless tobacco products that are very important for the end user. Among them, the organoleptic properties, such as texture, aroma, taste, form and package of the product are of high importance for the consumer. Thus, depending on the desired characteristics and the end use of the smokeless tobacco products, there is still a need for oral smokeless tobacco products that possess desired properties and can be efficiently produced.

SUMMARY OF THE INVENTION

The present invention provides an oral smokeless tobacco composition and a method of manufacturing the oral smokeless tobacco composition.

The smokeless tobacco composition and the method of its manufacturing according to the present invention are defined in the appended claims.

In a first aspect the invention provides an oral smokeless tobacco composition comprising liberated, delignified tobacco fibres, wherein the liberated, delignified tobacco fibres are 1 to 75 weight percent of the dry weight of the final composition, and wherein the liberated, delignified tobacco fibres have an average length to width ratio greater than 4:1 and equal to or lower than 100.1.

In a second aspect the invention provides a process for the manufacturing of a smokeless tobacco composition according to the first aspect of the invention, wherein the method comprises:

providing a tobacco material;

processing the tobacco material;

adding liberated, delignified tobacco fibres, wherein the liberated, delignified tobacco fibres are mixed with the tobacco material into a uniform blend.

Another aspect of the present invention is a pouch containing a smokeless tobacco composition according to the first aspect of the invention.

A further aspect of the present invention is the use of liberated, delignified tobacco fibres according to the invention in an oral smokeless tobacco composition

SHORT DESCRIPTION OF THE FIGURES

FIG. 1. The principle of the manufacturing process according to GothiaTek® standard, as used for the manufacturing of Scandinavian type moist snuff (snus).

Figure 2:
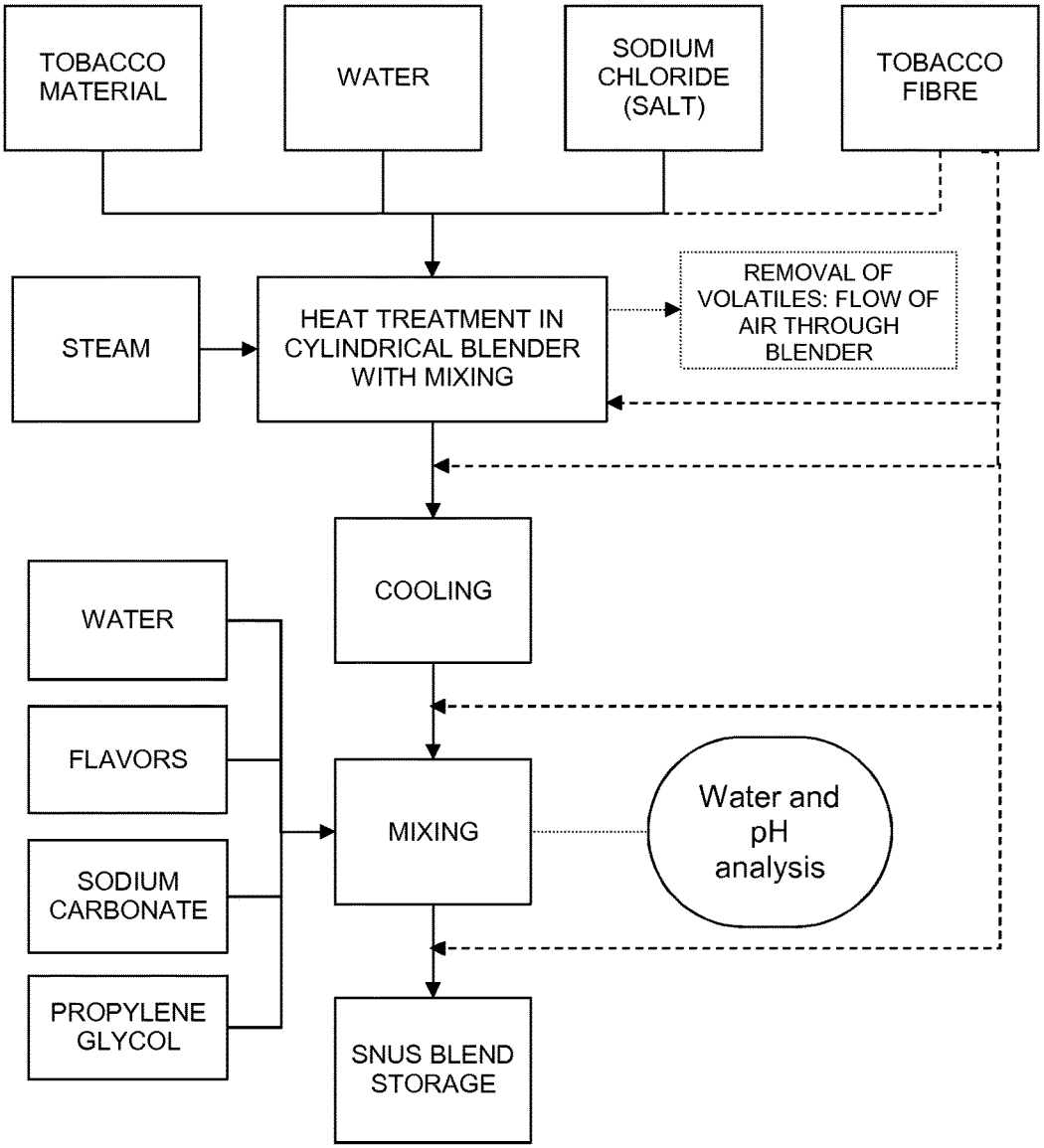

FIG. 2. Principle of the manufacturing process according to the present invention.

Figure 3:
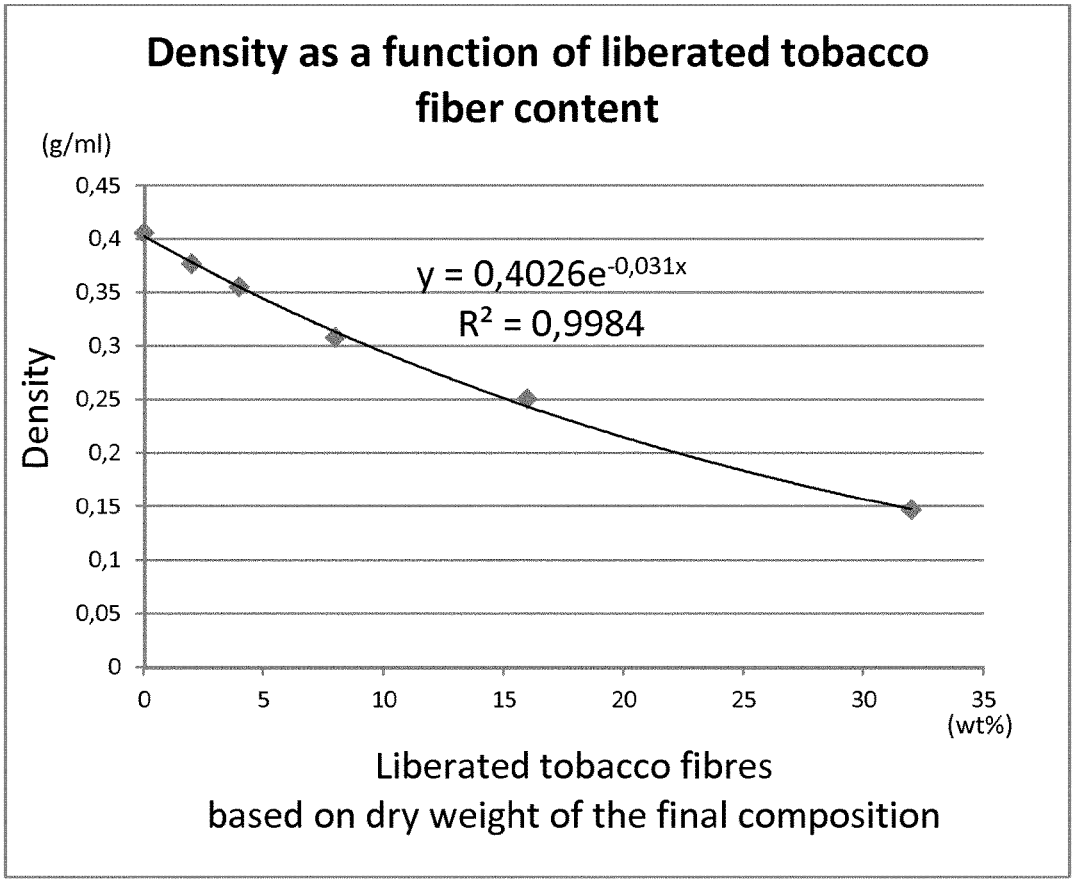

FIG. 3. Graph showing the density of a smokeless tobacco composition as a function of content of liberated, delignified tobacco fibres.

FIG. 4. Microscope pictures of a) a smokeless tobacco composition without liberated, delignified tobacco fibres and b) a smokeless tobacco composition comprising 4 wt % liberated, delignified tobacco fibres based on the dry weight of the final composition.

DETAILED DESCRIPTION OF THE INVENTION

By "tobacco" is meant any part, e.g., leaves, stems, and stalks, of any member of the genus *Nicotiana*. The tobacco may be whole, shredded, threshed, cut, ground, cured, aged, fermented, or otherwise, e.g., granulated or encapsulated. Tobacco may also be in the form of finished products, including any smokeless tobacco compositions that are orally consumed. Such smokeless tobacco compositions include snuff, moist snuff, such as snus, or dry snuff and chewing tobacco.

"Oral" and "oral use" is in all contexts used herein as a description for use in the oral cavity, i.e. chewing purposes, or buccal placement.

"Snus", which is the Swedish term for oral snuff, is used herein as a description for an oral tobacco product produced in a heat-treatment process instead of fermentation. The tobacco product may be provided in particulate form, as a loose powder, or portion packed in a pouch. Particulate is used herein for a particle size of the product which enables the final product to be provided in so-called loose form, from which a pinch of snus may be made in individual sizes by the person using the product. The final water content is typically higher than 40 wt %, but semi-dry products having less than 40 wt % water content and typically less than 30 wt % water content, are also available. Snus is typically used between the upper gum and lip.

Chewing tobacco is most often made of loose leaf tobacco. Chewing tobacco is normally used by putting a pinch of the loose leaf chewing tobacco or a bite of the plug or twist in the lower part of the mouth between the lower gum and lip. Scandinavian chewing tobacco is normally used in the same way as snus. By chewing the tobacco once in a while, flavour is released more efficiently. Chewing tobacco as referred to here is the typical kind of chewing tobacco used in North America, commonly known as "chew" or "chaw", or Scandinavian chewing tobacco.

American-type moist snuff for oral use is commonly produced through a fermentation process of moisturized ground or cut tobacco. American-type moist snuff is available in a loose form or as pre-packed pouches and is most commonly used between the lower gum and lip but could also be used as snus between the upper gum and lip. The water content is typically higher than 40 wt %.

Dry snuff for oral use have a low water content, typically less than 10 wt %, and is commonly made from fire-cured fermented tobacco. The tobacco is ground into a powder and other flavour ingredients added.

The term "tobacco material" is used herein for tobacco leaves or parts of leaves, i.e. lamina and stem, wherein the leaves and parts of leaves are finely divided, such as ground, cut, shredded or threshed, and the parts of leaves are blended in defined proportions.

The term "tobacco residue material" is used herein for the parts of the tobacco plant that remain after harvest of the tobacco leaves, such as stalks and stems, in particular stalks. Thus, the tobacco leaves are excluded from the term tobacco residue material as used herein.

"Delignified tobacco fibres" is used herein for fibres that are obtained from tobacco, such as from the stalk or stem of a tobacco plant, by removal of most of the lignin, such that the delignified tobacco fibres comprise less than 5 wt %, or less 4.5 wt % or less than 4 wt %, lignin on pulp (dry material). As used herein, delignification of tobacco fibers means that the lignin content is significantly reduced. However, there may still be some lignin present in the delignified tobacco fibers even though the content of lignin on pulp (dry material) is less than 5 wt %, or less 4.5 wt % or less than 4 wt %. The delignified tobacco fibres used in the oral smokeless tobacco composition according to the present invention are obtained by chemical processing of tobacco, for example by a chemical pulping process such as soda cooking, i.e. strong alkaline treatment of the tobacco. For example, the tobacco stalks and/or stems may be cooked with sodium hydroxide (NaOH), wherein the charge of NaOH is at least 150 kg/ton; at a high temperature, such as at a temperature of at least 150° C.; for at least 2 hours.

Chemical delignification of tobacco plant material reduces the content of lignin which binds the cellulose fibers together without seriously degrading the cellulose fibers. Thus, chemical delignification of tobacco is freeing tobacco fibers from each other. Normally, the free, delignified tobacco fibres used in the oral smokeless tobacco composition according to the invention have not been acid hydrolyzed.

"Liberated tobacco fibres" is used herein for delignified tobacco fibres that are defibrized, i.e. the fibres are released from each other. Liberated, delignified tobacco fibres as used in the present invention may not be obtained solely by mechanical treatment, such as cutting, grinding, shredding or threshing, of the tobacco material.

The liberated, delignified tobacco fibres as used in the manufacture of the oral smokeless tobacco composition according to the invention may be derived from tobacco residue material.

As used herein, the expression "water content" means the total water content in a smokeless tobacco composition, i.e., a tobacco material/fibre/additive/blend (including natural water contained in the materials used, as well as added pure water) as measured by using a standardized method for water analysis, such as, Karl Fischer titration or gas chromatography (GC). The water content is given herein as percent by weight (wt %).

As used herein, the expression "dry weight" means the weight of a smokeless tobacco composition, i.e. a blend of tobacco material, liberated, delignified tobacco fibres and additives, excluding the weight of water and possibly also other substances that may evaporate from a smokeless tobacco composition during drying, such as humectants. Accordingly, the expression "wt % based on the dry weight of the final composition" means, for example, the weight of the tobacco material, the liberated, delignified tobacco fibres, additives, or added flavours, divided by the total weight of all components included in the final composition excluding the weight of water in the final composition and possibly other substances that may evaporate from the final composition during drying of the product before analysis of its content.

The term "additive" as used herein denotes substances other than tobacco material, water and liberated, delignified tobacco fibres.

"Flavour" is used herein for a substance used to influence the aroma and/or taste of the smokeless tobacco product, including, but not limited to, essential oils, single flavour compounds, compounded flavourings, and extracts.

There are over 1500 varieties of *Nicotiana* (tobacco) with quite varying properties. Smokeless tobacco compositions are produced from tobacco leaves, which consists of lamina and stem. Nicotine levels in lamina and stems depend on several factors, such as the tobacco variety, leaf position on the plant, agricultural practices, fertilizer treatment, degree of ripening, curing time and curing condition. In fact, every step in tobacco production may influence the level of nicotine to a certain degree. Furthermore, depending on blending recipe, type and amount of additives, and product design all types of tobacco products contain a very wide range of nicotine concentration. Also, the roots and stalks of the tobacco plant contain a certain amount of nicotine.

Smokeless tobacco compositions with a high content of lamina tend to make the smokeless tobacco product stickier and this type of smokeless tobacco compositions also tend to have higher nicotine content. Excessive stickiness of smokeless tobacco compositions causes a considerable amount of the smokeless tobacco composition to build up deposits on machine surfaces used for production and packaging of the smokeless tobacco composition product, which generates wastage, such as loss of tobacco material, smokeless tobacco composition and rejection of pouches, and thus increased production costs. Further, the deposits cause variations in pouch weight and also increased break frequency in the production, resulting in not only decreased product uniformity but also reduced production efficiency. In the extreme case the stickiness and the associated build-up of deposits of smokeless tobacco composition fragments on machine surfaces may completely prevent production of the smokeless tobacco composition.

The organoleptic properties of a smokeless tobacco composition, such as texture and taste, are important for the consumer. The weight ratio between stem and lamina is one of the factors that usually affects the texture, and the nicotine content of a smokeless tobacco composition made thereof. Extensive efforts are required in order to be able to formulate a smokeless tobacco composition using tobacco originating from different tobacco varieties and balancing the weight ratio of lamina to stem to achieve the desired texture, nicotine content and taste. There are several different limitations determining how these compositions may be formulated in order to obtain the desired characteristics. Oftentimes an experimental composition may have a desirable taste but an undesired texture. Thus, it is desirable to have a means to provide the product with the desired texture without impacting its taste or compromising the health of the consumer.

An advantage with the use of liberated, delignified tobacco fibres in the oral smokeless tobacco composition according to the present invention is that the texture and nicotine content can be regulated, while at the same time more parts of the tobacco plant in addition to the leaves may be used.

The liberated, delignified tobacco fibres used in the smokeless tobacco composition according to the present invention may be made from any part of the tobacco plant, for example the stem or stalk, in particular the stalk. Thus, a further advantage with the present invention is that it makes it possible to use almost any variety of tobacco and any part of the tobacco plant, including the unutilized tobacco stalks that remain after harvest of tobacco leaves, and still be able to produce the desired end product.

Thus, the present invention enables the use of tobacco varieties or weight ratios between lamina and stem and also parts of the tobacco plant that otherwise would not be preferred for use in the production of smokeless tobacco compositions, such as the stalk. This means that waste from tobacco plantations can be reduced.

Another advantage with the smokeless tobacco composition according to the present invention is that the amount of the composition that deposits on the process equipment may be significantly reduced, while the organoleptic properties are preserved.

A further advantage of the smokeless tobacco composition according to the present invention is that it is convenient to pack in pouches and thereby the rejection of pouches not fulfilling the product requirements and thus the packaging waste is significantly reduced during production compared to smokeless tobacco compositions without liberated, delignified tobacco fibres of the present invention.

Another property relevant for the use of the smokeless tobacco product is the rate of extraction of flavour and nicotine. It is generally advantageous to have a high rate to provide a fast satisfaction, reducing nicotine craving and provide an initial strong flavour experience. The rate of extraction depends on the compactness of the pouch or the pinch formed by smokeless tobacco composition in loose form, where a more open structure would provide a faster extraction rate. It is thus desirable to be able to reduce the compactness of the smokeless tobacco composition in order to increase the extraction rate of nicotine and flavour. Nicotine extraction from a smokeless tobacco product when used by a consumer is never complete. Typically a consumer removes the smokeless tobacco product after 20 minutes to an hour. There is a significant variation between consumers to what extent they extract nicotine from a smokeless tobacco product. In rare cases 50% of total nicotine content is extracted, while in other cases only 10% is extracted.

An advantage with the smokeless composition according to the present invention is that the extraction rate of nicotine may be regulated by modifying the compactness of the composition by varying the content of liberated, delignified tobacco fibres in the composition. With the smokeless tobacco composition comprising liberated, delignified tobacco fibres according to the present invention the rate of nicotine extraction can be increased, i.e. higher amounts of nicotine can be extracted for the same period of use, compared with a corresponding smokeless tobacco composition that comprises the same amount of tobacco material, optionally including other ingredients, but being without the liberated, delignified tobacco fibres used in the present invention.

Further, users of smokeless tobacco compositions, such as moist snuff, generally prefer a certain size of the pouch. If and when a smaller pouch is tried many consumers feel that something is missing between the gum and lip where consumers normally place their tobacco. For pre-packed pouches of smaller size it would be desirable to be able to increase the size, i.e. reduce the volume weight, also termed density, to provide the desired mouth feel for the consumer while keeping the same amount of tobacco and thereby nicotine content in the composition. For smokeless tobacco compositions in loose form, such as loose snuff, it is advantageous for the consumer to be able to form a pinch of desired size regardless of the type of tobacco material used in the composition.

Another advantage with the use of liberated, delignified tobacco fibres in the oral smokeless tobacco composition according to the present invention is that a considerable decrease in density may be provided, i.e. increased volume per unit weight, compared to corresponding smokeless tobacco compositions for oral use not containing liberated, delignified tobacco fibres. With a smokeless tobacco composition according to the present invention the weight of the pouch might be decreased without any volume decrease and thereby the desired size can be maintained.

Incorporation of liberated, delignified tobacco fibres in the smokeless tobacco composition according to the present invention may also provide the product with a more spongy character that is experienced as increased softness and also enables a product that easily adapts its shape to the curvature of the space between the lip and the gum, which may be expressed by consumers as better fit.

Some consumers prefer drier products while others prefer more moist products, so there is a merit in offering a range of smokeless tobacco products with different water contents to the consumers. A particular problem for the manufacturing of products with high water content is to provide a composition wherein leaking of water is avoided. It is, thus, desirable to provide a smokeless tobacco composition for oral use comprising a high content of water with an increased water holding capacity.

Smokeless tobacco products may have a water content ranging from around 10 wt % for very dry products up to around 60 wt % and even higher for products with the highest water content. The water holding capacity of the smokeless tobacco compositions affects the moist feeling of the product. A composition having a high water holding capacity can feel drier than a composition with a lower water holding capacity, although the compositions have the same water content.

It is speculated that the presence of voids in the structure of the smokeless tobacco composition is important for the water holding capacity. Although not conclusively shown, the presence of voids should be connected to the volume weight, or density.

An advantage with the smokeless tobacco composition according to the present invention comprising the liberated, delignified tobacco fibres is that the water holding capacity may be increased.

Liberated, delignified tobacco fibres used in the smokeless tobacco composition according to the present invention are delignified tobacco fibres that are liberated from tobacco, such as from tobacco stalks or stems or any other part of the tobacco that is suitable for obtaining liberated, delignified fibres.

The liberated, delignified tobacco fibres used in the present invention are chemically liberated from tobacco. Chemically liberated, delignified tobacco fibres can be obtained from tobacco, such as from tobacco stalks, by de-barking, and cleaving parts of tobacco, removing the pith, followed by chopping the de-pithed tobacco parts into splinters and then chemically treating the de-barked and de-pithed splinters, for example by soda cooking. The splinters may be dried to >90 wt % and cut into chips with an average size of 40 mm before chemical treatment. The chemical treatment may be performed by soda cooking, i.e. strong alkaline treatment of the tobacco, such as cooking the tobacco stalks or stems or both with sodium hydroxide (NaOH), wherein the charge of NaOH is at least 150 kg/ton dry tobacco, or at least 200 kg/ton dry tobacco. Typically, soda cooking of tobacco for several hours at a high temperature, such as at a temperature of at least 150° C., or at least 165° C. for at least 2 hours, or at least 3 hours, or at least 4 hours, or at least 5 hours is required to obtain delignified tobacco fibres. An advantage with longer cooking times is that the reject, i.e. large shives, knots, dirt and other debris not comprising liberated tobacco fibres, is reduced.

The soda cooking process for obtaining liberated delignified tobacco fibres to be used in the smokeless tobacco composition for oral use according to the present invention is preferably made without anthraquinone.

An advantage with using soda cooking with sodium hydroxide is that the hydroxide ions constitute the active cooking constituent and a recovery cycle of the cooking chemicals is therefore not required.

Any other known chemical pulping method that can produce liberated, delignified tobacco fibres suitable for use in the invention may be used. For example, kraft pulping combined with a pre-hydrolysis step (Sven A. Rydholm, Pulping processes, Interscience Publishers, 1965) and acid bisulphite pulping (V. Chunilall et al. Holzforschung, Vol. 64, pp. 693-698, 2010) may be used.

The lignin content in a cellulose material can be measured by acid hydrolysis of the material followed by analysis of the acid-insoluble residue and acid-soluble residue. Acid-insoluble residue is generally determined gravimetrically according to TAPPI T222 om-11. Acid-soluble residue is generally measured by UV spectrophotometry at 205 nm. The total lignin content is the sum of the amount of acid-soluble and acid insoluble residue. Details for measurement of the lignin content in liberated, delignified tobacco fibres with acid-hydrolysis are found in Example 3 herein. The liberated, delignified tobacco fibres in the smokeless tobacco composition according to the present invention comprises equal to or less than 5 wt %, equal to or less than 4.5 wt %, or equal to or less than 4 wt %, lignin on pulp (dry material), as measured by acid hydrolysis. It is not possible to obtain liberated tobacco fibres from a tobacco pulp comprising more than 5 wt % lignin on pulp (dry material).

Solid state NMR (CP/MAS 13C-NMR) can be used to estimate the degree of crystallinity in semi-crystalline organic solids such as cellulose. The liberated, delignified tobacco fibres used in the present invention may have a degree of crystallinity of at least 45%, as measured by solid state NMR according to K Wickholm et al., Carbohydrate Research 312 (1998) 123-129; and PT Larsson et al., Carbohydrate Research 302 (1997) 19-25.

Fibres and fibre ensembles are often described by their dimensions, for example by averages or distributions of length, width, length-to-width ratio and other aspects. One of the characteristics of importance in the present invention is their average length-to-width ratio. In general, the most simple way of calculating average fibre length is the numerical average fibre length $\bar{x}_a$, also known as the arithmetical average fibre length. The numerical average fibre length is calculated with formula 1, where $x_i$ is the length of the fibres in each size class, i, and n the total number of fibres.

$$\bar{x}_a = \frac{\sum_i n_i x_i}{\sum_i n_i} \tag{1}$$

However, a commercial fibre composition typically contains a large number of very small particles, so called fines, although these constitute only a small volume of the total fibre composition. Due to their large number, the small particles thus have a great impact on the numerical average fibre length for the fibre composition giving a smaller value compared with other ways to calculate the average fibre length. Therefore, formula (1) is not suitable for characterising the liberated, delignified tobacco fibres used in the present invention. Instead, throughout the present invention, the following formula (2) is used for calculating the length-weighted average fibre length $\bar{x}_l$ of the liberated, delignified tobacco fibres used in the present invention $$\bar{x}_l = \frac{\sum_i l_i x_i}{\sum_i l_i} \tag{2}$$

wherein $\bar{x}_l$ represents length-weighted average length, as defined in the STFI Fiber Master, STFI report TF 70, 1997, STFI, Stockholm, and where $x_i$ in this case is equal to $l_i$, i.e. the average length of the fibres in each size class. The STFI Fiber Master is an instrument for studying fibre dimensions and is equivalent to the Fiber Tester from Lorentzen & Wettre.

The variation in fibre width is typically much smaller than the variation in fibre length and thus the average fibre width is calculated as the numerical average fibre width.

Throughout the present invention the expression "average length-to-width ratio" of the liberated, delignified tobacco fibres denotes the ratio of the length-weighted average fibre length to the numerical average fibre width.

An instrument suitable for measurements on fibres is the Fiber Tester from Lorentzen & Wettre (L&W). With this instrument the material is analyzed in wet dispersion and the area and perimeter of a fibre is measured from a digital image. The fibre length is calculated as perimeter/2 and the width as area/length.

Calculations of fibre dimensions and distributions may be performed with software such as MatLab from MathWorks.

Delignified, liberated tobacco fibres, used in the smokeless tobacco composition of the present invention have an average length-to-width ratio equal to or greater than 4:1. An object according to the first aspect of the present invention is thus to provide an oral smokeless tobacco composition comprising liberated, delignified tobacco fibres having an average length-to-width ratio, i.e. the length-weighted average fibre length to the numerical average fibre width, equal to or greater than 4:1, equal to or greater than 7:1, equal to or greater than 9:1, equal to or greater than 12:1, equal to or greater than 15:1, equal to or greater than 18:1, equal to or greater than 20:1, equal to or greater than 25:1 and equal to or greater than any number in-between 4:1 and 25:1, as measured by L&W Fiber Tester.

The liberated, delignified tobacco fibres used in the smokeless tobacco composition according to the present invention have an average length-to-width ratio equal to or lower than 100:1, preferably equal to or lower than 60:1, more preferably equal to or lower than 40:1.

The length-weighted average fibre length of suitable liberated, delignified tobacco fibres according to the invention may be greater than about 100 μm, greater than 200 μm, greater than 300 μm, greater than 400 μm, or greater than 500 μm. The length-weighted average fibre length of suitable liberated, delignified tobacco fibres according to this invention may not be greater than about 3 mm, preferably not greater than 2 mm.

The number-weighted average fibre width of suitable liberated, delignified tobacco fibres according to the invention may be from about 34 μm to about 42 μm, in particular from about 39 to about 42 μm.

The liberated, delignified tobacco fibres used in the smokeless tobacco composition according to the present invention may be a combination of liberated, delignified tobacco fibres of different length-weighted average fibre length.

A suitable amount of the liberated, delignified tobacco fibres in the smokeless tobacco composition depends on, inter alia, the desired density of the smokeless tobacco composition. The smokeless tobacco composition according to the present invention comprises from 1 wt % to 75 wt % liberated, delignified tobacco fibres, based on the dry weight of the final composition. The smokeless tobacco composition according to the invention may alternatively comprise at least 2 wt %, at least 4 wt %, or at least 8 wt %, liberated, delignified tobacco fibres, based on the dry weight of the final composition. Further, the smokeless tobacco composition may comprise equal to or lower than 32 wt %, or equal to or lower than 16 wt %, liberated, delignified tobacco fibres, based on the dry weight of the final composition. The smokeless tobacco composition of the invention may comprise liberated, delignified tobacco fibres in an amount of about 2 wt % to about 32 wt % and any number in between, based on the dry weight of the final composition.

In an embodiment of the oral smokeless tobacco composition according to the invention, the oral smokeless tobacco composition comprises:

from 25 to 99 wt %, such as 40 to 95 or 50 to 85 wt %, based on the dry weight of the composition, of tobacco material; and from 1 wt % to 75 wt %, such as from 2 to 32 wt % or 4 to 32 wt % or 8 to 32 wt % or 2 to 16 wt %, based on the dry weight of the composition, of liberated, delignified tobacco fibres derived from tobacco residue material.

In particular, the oral smokeless tobacco composition may comprise:

from 25 to 99 wt %, such as 40 to 95 or 50 to 85 wt %, based on the dry weight of the composition, of tobacco material from tobacco leaves; and from 1 wt % to 75 wt %, such as from 2 to 32 wt % or 4 to 32 wt % or 8 to 32 wt % or 2 to 16 wt %, based on the dry weight of the composition, of liberated, delignified tobacco fibres from tobacco stalks.

The smokeless tobacco composition for oral use of the present invention may be moist snuff, such as snus.

The smokeless tobacco composition may comprise 10 to 70 wt % water, 10 to 60 wt % water, 25-60 wt % water, or 30 to 50 wt % water, based on the total weight of the final composition.

The smokeless tobacco composition according to the present invention may contain further ingredients in addition to tobacco material, liberated, delignified tobacco fibres, and water, for example humectants, such as glycerol and propylene glycol, sodium chloride (NaCl), additional salt(s), such as a carbonate, for example sodium carbonate, and/or ammonium chloride, a dye, such as, caramel (E150), or vegetable carbon (E153) and flavours.

The flavours may be selected from the group comprising fruits, berries, flowers, herbs, oil of fruits and edible plants or a combination thereof. In addition to natural flavour extracts, flavour may also be provided by imitation, synthetic or artificial flavour ingredients and blends containing such ingredients. Flavours may be added as a powder, a liquid, or in encapsulated form.

Moreover, the oral smokeless tobacco composition according to the present invention may in addition contain one or more types of non-tobacco fibers, such as maize fibres, oat fibers, tomato fibers, barley fibers, rye fibers, sugar beet fibers, buckwheat fibers, potato fibers, apple fibers, cocoa fibers, hay fibers, bamboo fibers and chemo-thermo-mechanical (CTMP) fibers from, for instance, spruce or pine. The hay, bamboo and chemo-thermo-mechanical (CTMP) fibers may an average length-to-width ratio equal to or greater than 3.5:1 and equal to or lower than 100:1 as disclosed in WO 2013/152918. An example of bamboo fibers is Vitacel® Bamboo Fiber of grades BAF 200 and BAF 400 DV, supplier J. Rettenmaier & Söhne GMBH+CO.KG, (JRS).

Another object of the present invention is use of liberated, delignified tobacco fibres in a smokeless tobacco composition for oral use.

The oral smokeless tobacco composition according to the present invention may be provided in loose form packed in a container, such as a can or a box with a lid.

The oral smokeless tobacco composition according to the present invention may be provided in the form of a portion package, such as a pouch, which then may be packed in a container, such as a box.

The present invention also provides a pouch containing the smokeless tobacco composition of the invention. By varying the concentration of the liberated, delignified tobacco fibres in the tobacco composition it is possible to control the weight of the pouch so that the weight of the pouch can be varied while keeping the volume constant without changing the overall consumer experience. Thus, although the total pouch weight may decrease the volume will remain constant without affecting the desired consumer satisfaction.

Another object of the present invention is to provide a product comprising the smokeless tobacco composition according to the invention in a box or bag made out of cellulose and/or metal and/or a polymer.

Manufacturing processes of oral smokeless tobacco products, e.g. moist snuff and chewing tobacco, are well known to the person skilled in the art, and any known process thereof may be used. Moist snuff is known as either Swedish-type snus or American-type moist snuff.

A general description of snus manufacturing is presented by e.g. ESTOC, European Smokeless Tobacco Council, and the GothiaTek® quality standard for snus. Methods for the manufacture of American type moist snuff and chewing tobacco are described in e.g. Wahlberg, I., Ringberger, T. (1999) Smokeless Tobacco. In: Tobacco: *Production, Chemistry and Technology*, (eds D. L. Davis & M. T. Nielsen) pp. 452-460. World Agriculture Series, Blackwell Science Ltd.

The smokeless tobacco product according to the present invention is preferably manufactured according to the GothiaTek® standard.

The liberated, delignified tobacco fibres used in the composition according to the present invention may be added anywhere in the manufacturing process as long as uniform distribution of the liberated, delignified tobacco fibres in the final tobacco smokeless composition is achieved, i.e., a uniform blend of the final composition is obtained. All the liberated, delignified tobacco fibres may be added at one stage in the process, such as either prior to the processing, during processing or after the processing of the tobacco material. Alternatively the addition of liberated, delignified tobacco fibres may be made at two or more different stages in the process. For example, one portion of the liberated, delignified tobacco fibres may be added to the tobacco material, while another portion may be added further down the process, such as immediately before packing the smokeless tobacco composition in pre-packed portions. FIG. 2 shows the principle of the manufacturing process according to the present invention wherein the liberated, delignified tobacco fibres are added together with tobacco material, water and sodium chloride. As long as a uniform distribution of the liberated, delignified tobacco fibres is achieved the liberated, delignified tobacco fibres or a part of the total added liberated, delignified tobacco fibres may be added later in the manufacturing process, as shown by the dotted line in FIG. 2.

The present invention also provides a method wherein the processing of the tobacco material comprises a heat treatment, preferably a pasteurization process.

Further, the present invention also provides a method for manufacturing the smokeless tobacco composition for oral use according to the present invention, wherein the liberated, delignified tobacco fibres are added prior to the processing of the tobacco material.

In the method of the present invention, the liberated, delignified tobacco fibres may also or alternatively be added during the processing of the tobacco material, optionally including other ingredients.

In the method of the present invention, the liberated, delignified tobacco fibres may be also or alternatively be added after the processing of the tobacco material, optionally including other ingredients.

The present invention also provides a method for manufacturing the smokeless tobacco composition for oral use according to the present invention, wherein water, and optionally salt, such as sodium chloride (NaCl), and possibly additional additives, may be added to the smokeless tobacco composition before the processing of the tobacco material, or at the start of the processing of the tobacco material, preferably before the heat treatment.

The liberated, delignified tobacco fibres may be added to the tobacco material as early as possible in the method according to the present invention, such as at the earliest possible stage of the processing of the tobacco material. The incorporation of the liberated, delignified tobacco fibres is easier and requires less mixing when the tobacco material has low water content. When water, salt and other ingredients are added, the total water content of the composition may increase and thus render mixing more difficult. Accordingly, the present invention also provides a method wherein the liberated, delignified tobacco fibres are mixed with the tobacco material before water is added.

Late addition of the liberated, delignified tobacco fibres may still provide improvement in all above identified improvement areas. Therefore, the present invention also provides a method wherein the liberated, delignified tobacco fibres are added and incorporated in the finished composition just prior to packing.

Water, and optionally flavours, sodium carbonate and possibly additional additives may be added to the smokeless tobacco composition prior to the processing of the tobacco material, during the processing of the tobacco material, or after the processing of the tobacco material. The present invention also provides a method wherein water, flavours, sodium carbonate and possibly additional additives are added during the processing of the tobacco material.

The method according to the present invention, since it follows the procedure of GothiaTek® standard, implies hygienic handling of all ingredients and pasteurization of the loaded materials, thus assuring a final composition with negligible levels of bacteria.

The manufacturing method according to the present invention may preferably be kept in a closed system and handling of all ingredients complies with food safety regulations.

The invention is further illustrated by means of the following non-limiting examples. Parts and percentages relate to parts by weight and percent by weight, respectively, unless otherwise stated.

EXAMPLES

All smokeless tobacco compositions were manufactured in accordance with GothiaTek® standard.

Example 1

Preparation of liberated, delignified tobacco fibres from tobacco stalks.

Tobacco stalks from tobacco plants grown in Spain were de-barked, cleaved and carefully de-pithed by hand, followed by chopping the de-pithed stalk into splinters, about 60-70 mm in length and a width of about 5 mm. The splinters were air-dried to a dry content of about 90%. Before further processing the splinters were cut to smaller pieces of approximate average size of 40 mm.

The air-dried splinters were impregnated with water over night at 20° C. Sodium hydroxide was added (240 kg NaOH/ton dry tobacco material), corresponding to an effective alkali charge (EA) of 24% and a liquor-to-material ratio (l/kg) of 6:1 followed by impregnation at 110° C. for 30 min to obtain alkali impregnated splinters. The impregnated splinters were then cooked at 170° C., for 300 minutes to produce tobacco pulp. The alkali consumption was 216 kg NaOH/ton dry de-pithed and de-barked tobacco material. The delignified fibres were screened in a water jet defibrator (NAF, Nordiska Armatur Fabriken, Sweden) with 1 mm perforations followed by screening over a Wennberg screen with 0.15 mm slots to obtain liberated, delignifed toabcco fibres. The resulting fibre yield was 33% on charged dry, de-barked and de-pithed tobacco material.

The length-weighted average fibre length of the liberated, delignified tobacco fibres was 0.91 mm and the number-weighted average width was 40.2 μm. The length-to-width ratio was 23, based on all objects (i.e. fibres and particles).

The fibres were analysed on the L&W Fiber Tester. The standard set-up of a Fiber Tester define fibres as particles longer than 0.2 mm and with a length to width ratio greater than 4. When calculating only particles longer than 0.2 mm and length-to-width ratio greater than 4:1, the length-weighted average fibre length of the liberated, delignified tobacco fibres was 1.01 mm and the number-weighted average width was 34.5 μm. The length-to-width ratio was 29.

Example 2

Preparation of liberated, delignified tobacco fibres from tobacco stalks.

Tobacco stalks from tobacco plants grown in Spain were de-barked, cleaved and carefully de-pithed by hand, followed by chopping the de-pithed stalk into splinters, about 60-70 mm in length and a width of about 5 mm. The splinters were air-dried to a dry content of about 90%. Before further processing the splinters were cut to smaller pieces of approximate average size of 40 mm.

The air-dried splinters (974 g) were placed in deionised water at I:m 6:1 (liquor-to-material ratio (I/kg)) and subjected to vacuum for 30 min, followed by impregnation over night at 20° C., under nitrogen atmosphere (5 bar). After impregnation the temperature was increased during 10 min from 20° C. to 110° C. and then at a rate of 3° C./min from 110° C. to 140° C. and kept at 140 at a rate of 3° C./min for 60 min followed by cooling to room temperature. The obtained hydrolysate was withdrawn to reach I:m of 2:1. Sodium hydroxide was added (250 kg NaOH/ton dry tobacco material), corresponding to an effective alkali charge (EA) of 25% and I:m of 6:1 followed by impregnation at 110° C. for 40 min to obtain alkali impregnated splinters. The temperature was increased at a rate of 3° C./min from 110° C. to 170° C., and then kept at 170° C. for 300 minutes to produce tobacco pulp. The cook was terminated by cooling the autoclave in cold water for 10 minutes and with-drawing the obtained black-liquor. The alkali consumption was 209 kg NaOH/ton dry de-pithed and de-barked tobacco material. The delignified fibres were screened in a water jet defibrator (NAF, Nordiska Armatur Fabriken, Sweden) with 1 mm perforations followed by screening over a Wennberg screen with 0.15 mm slots slots to obtain liberated, delignifed toabcco fibres. The resulting fibre yield was 35.5% on charged dry, de-barked and de-pithed tobacco material.

The length-weighted average fibre length of the liberated, delignified tobacco fibres was 0.97 mm and the number-weighted average width was 40.7 μm. The length-to-width ratio was 24, based on all objects (i.e. fibres and particles).

The fibres were analysed on the L&W Fiber Tester. The standard set-up of a Fiber Tester define fibres as particles longer than 0.2 mm and with a length to width ratio greater than 4. When calculating only particles longer than 0.2 mm and length-to-width ratio greater than 4:1, the length-weighted average fibre length of the liberated, delignified tobacco fibres was 1.04 mm and the number-weighted average width was 35.8 μm. The length-to-width ratio was 29.

Example 3

Liberated, delignified tobacco fibres as produced according to Example 2, were used to study the effect on the density of smokeless tobacco compositions by adding different amounts of liberated, delignified tobacco fibres. Smokeless tobacco compositions were prepared with ingredients according to Table 1. Liberated, delignified tobacco fibres were added in Sample 2, 4, 8, 16 and 32 to reach concentrations of 2 wt %, 4 wt %, 8 wt %, 16 wt % and 32 wt %, respectively, based on the dry weight of the final composition. All compositions were produced in three replicates.

TABLE 1

| Sample | Ground Tobacco (g) Moisture content 7.61% | Liberated Delignified Tobacco fibres (g) Moisture content 8.78% | Sodium Chloride (g) | Sodium Carbonate (g) | Water (g) | Propylene Glycol (g) |
|---|---|---|---|---|---|---|
| 0 | 51.2 | 0.0 | 5.3 | 2.3 | 48.0 | 3.0 |
| 2 | 50.1 | 1.2 | 5.3 | 2.3 | 48.0 | 3.0 |
| 4 | 48.9 | 2.4 | 5.3 | 2.2 | 48.0 | 3.0 |
| 8 | 46.7 | 4.8 | 5.3 | 2.1 | 47.9 | 3.0 |
| 16 | 42.1 | 9.6 | 5.3 | 1.9 | 47.8 | 3.0 |
| 32 | 33.1 | 19.4 | 5.3 | 1.5 | 47.7 | 3.0 |

Ground tobacco material, liberated, delignified tobacco fibres and salt, in the amounts according to Table 1, were placed in a beaker and mixed with a hand blender (fabricate Moulinex Hapto Click and Mix) for 60 seconds at high speed. 35 g of the water were added to the beaker and mixed with hand blender (fabricate Moulinex Hapto Click and Mix) for 60 seconds at high speed to form a uniform blend of ground tobacco material, liberated, delignified tobacco fibres, sodium chloride (NaCl) and water.

The blend was then heated to 100° C. for 15 minutes followed by 24 hours at 80° C. in an oven. After heat treatment the blend was chilled to about 20° C. The sodium carbonate, propylene glycol and the remaining water were added to reach the respective amounts according to table 1, and the mixture was manually stirred with a spatula to a uniform blend to finalize the smokeless tobacco composition with final moisture content of 50%.

Figure 4A:
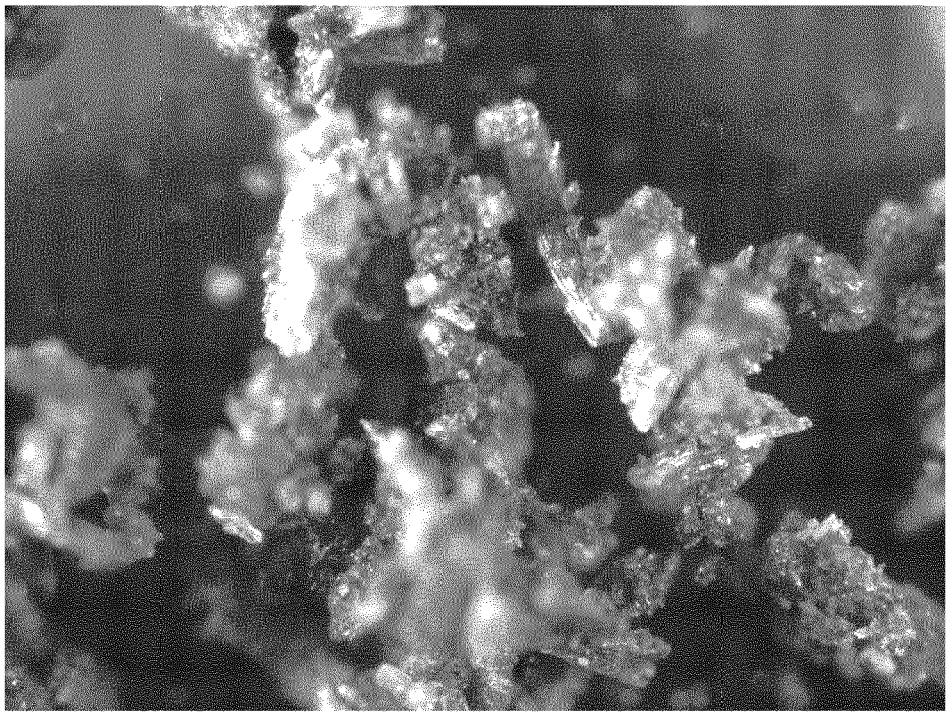
Figure 4B:
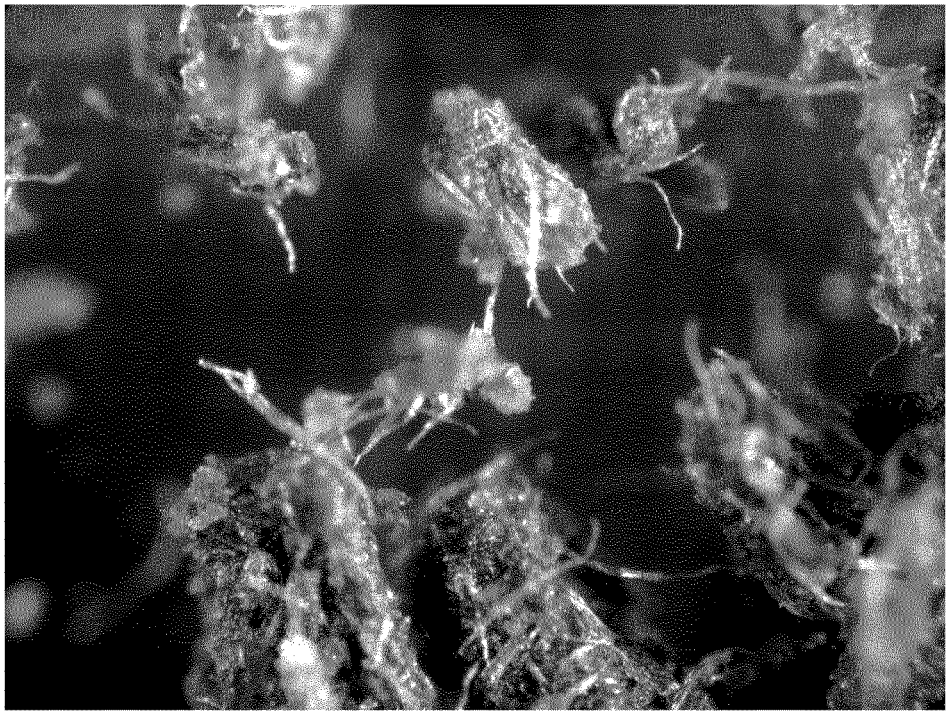

Each sample was poured up to 250 ml in a graduated cylinder and weighed. The average weight of the three replicates of each composition was calculated. The average density results are specified in Table 2, and the density change is illustrated in FIG. 3. The reference composition, wherein no liberated, delignified fibres were added, is depicted in FIG. 4*a*), while FIG. 4*b*) shows a composition comprising 4 wt % liberated, delignified tobacco fibres, based on the dry weight of the final tobacco composition.

TABLE 2

| Fibre content* (%) | Density** (g/ml) |
|---|---|
| 0 | 0.40 |
| 2 | 0.38 |
| 4 | 0.35 |
| 8 | 0.31 |

TABLE 2-continued

| Fibre content* (%) | Density** (g/ml) |
|---|---|
| 16 | 0.25 |
| 32 | 0.15 |

*Fibre content, dry fibre weight as percent of total dry material weight in the smokeless tobacco composition
**Average density Example 4

Measurement of lignin content in liberated, delignified tobacco fibres was made by acid hydrolysis. Samples of tobacco pulp prepared according to Example 1 and Example 2 were extracted with acetone in a Soxtec apparatus according to SCAN-CM 67:03 (Scandinavian Pulp, Paper and Board Testing Committee, Sweden). The extracted samples were hydrolyzed at 121° C. in an autoclave with 0.4M sulphuric acid, according to SCAN-CM 71:09 (Scandinavian Pulp, Paper and Board Testing Committee, Sweden). The solubilised monosaccharides were quantified using an ion chromatograph coupled to a pulsed amperometric detector (IC-PAD). Acid-insoluble residue was determined gravimetrically according to TAPPI T222 om-11 (TAPPI Test Methods, TAPPI Press, Norcross, Ga.). The acid-soluble residue was measured by UV spectrophotometry at 205 nm. Milli-Q water(purified water) was used as blank and for the dilution of hydrolyzate. The content of acid-soluble residue was calculated using the absorptivity coefficient 101/g*cm. The total content of lignin was calculated as the sum of the amount of acid-soluble and acid insoluble residue. Duplicate samples were analyzed. The absolute carbohydrate composition including acid insoluble and acid soluble residue, in mg/g of dry extracted sample (carbohydrates as anhydrous sugars), and the relative carbohydrate composition in weight % of dry material, is presented in Table 3. The total lignin content is 4 wt % on pulp (dry material).

TABLE 3

| | Example 1 | | Example 2 | |
|---|---|---|---|---|
| Substance | (mg/g) | (%) | (mg/g) | (%) |
| Arabinose | <1 | <0.1 | <1 | <0.1 |
| Galactose | <1 | <0.1 | <1 | <0.1 |
| Glucose | 694 | 69.4 | 691 | 69.1 |
| Xylose | 148 | 14.8 | 141 | 14.1 |
| Mannose | 5 | 0.5 | 4 | 0.4 |
| Total carbohydrates | 847 | 84.7 | 837 | 83.7 |
| Acid insoluble residue | 25 | 2.5 | 23 | 2.3 |
| Acid soluble residue | 11 | 1.1 | 10 | 1.0 |
| Total lignin (acid insoluble + soluble residue) | 36 | 3.6 | 33 | 3.3 |
| Total amount (total carbohydrates + total lignin) | 883 | 88.3 | 870 | 87.0 |

Averages of duplicate samples

Various aspects of the present invention have been described above but a person skilled in the art realizes further minor alterations, which would fall into the scope of the present invention. The breadth and scope of the present invention should not be limited by any of the above-described examples, but should be defined only in accordance with the following claims and their equivalents. Other aspects, advantages and modifications within the scope of the invention will be apparent to those skilled in the art to which the invention pertains.

The invention claimed is:

1. An oral smokeless tobacco composition comprising liberated, delignified tobacco fibres, wherein the liberated, delignified tobacco fibres are 1 to 75 weight percent of the dry weight of the oral smokeless tobacco composition, wherein the liberated, delignified tobacco fibres have an average length-to-width ratio equal to or greater than 4:1 and equal to or lower than 100:1, and wherein the liberated, delignified tobacco fibres have a number-weighted average width equal to or greater than about 34 μm to equal to or less than about 42 μm.

2. The oral smokeless tobacco composition according to claim 1, wherein the liberated, delignified tobacco fibres have an average length-to-width ratio equal to or greater than 15:1.

3. The oral smokeless tobacco composition according to claim 1, wherein the liberated, delignified tobacco fibres have an average length-to-width ratio equal to or greater than 20:1.

4. The oral smokeless tobacco composition according to claim 1, wherein the liberated, delignified tobacco fibres have an average length-to-width ratio equal to or greater than 25:1.

5. The oral smokeless tobacco composition according to claim 1, wherein the liberated, delignified fibres have a length-weighted average fibre length of 500 μm to 2 mm.

6. The oral smokeless tobacco composition according to claim 1, wherein the content of the liberated, delignified tobacco fibres in the composition is 2 to 32 weight percent based on the dry weight of the oral smokeless tobacco composition.

7. The oral smokeless tobacco composition according to claim 1, wherein the content of the liberated, delignified tobacco fibres in the composition is 2 to 16 weight percent based on the dry weight of the oral smokeless tobacco composition.

8. The oral smokeless tobacco composition according to claim 1, wherein the oral smokeless tobacco composition is a moist snuff.

9. The oral smokeless tobacco composition according to claim 8, wherein the oral smokeless tobacco composition is snus.

10. The oral smokeless tobacco composition according to claim 1, wherein the composition comprises 10-60 weight percent water, based on the total weight of the composition.

11. The oral smokeless tobacco composition according to claim 1, wherein the composition is provided in the form of a portion package or in loose form in a can or a box.

12. The oral smokeless tobacco composition according to claim 11, wherein the portion package is in the form of a pouch.

13. A method for manufacturing the oral smokeless tobacco composition according to claim 1, comprising:

providing a tobacco material;

processing the tobacco material;

adding the liberated, delignified tobacco fibres to the tobacco material, wherein the liberated, delignified tobacco fibres are mixed with the tobacco material into a uniform blend.

14. The method according to claim 13, wherein the processing of the tobacco material comprises heat treatment.

15. The method according to claim 14, wherein the heat treatment is a pasteurization process.

16. The method according to claim 13, wherein the liberated, delignified tobacco fibres are added prior to the processing of the tobacco material.

17. The method according to claim 13, wherein the liberated, delignified tobacco fibres are added during the processing of the tobacco material.

18. The method according to claim 13, wherein the liberated, delignified tobacco fibres are added after the processing of the tobacco material.

19. The oral smokeless tobacco composition of claim 1, wherein the liberated, delignified tobacco fibres comprise fibres that are released from one another.

20. The oral smokeless tobacco composition of claim 19, wherein the liberated, delignified tobacco fibres are not obtained solely by mechanical treatment of a tobacco material.

* * * * *